US010098437B2

(12) United States Patent
Kim

(10) Patent No.: US 10,098,437 B2
(45) Date of Patent: Oct. 16, 2018

(54) SPUIT-TYPE CONTAINER INCLUDING FLOCKING TIP HAVING TEMPORARY STORAGE

(71) Applicant: AMOREPACIFIC CORPORATION, Seoul (KR)

(72) Inventor: Jun Young Kim, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 190 days.

(21) Appl. No.: 15/232,528

(22) Filed: Aug. 9, 2016

(65) Prior Publication Data

US 2018/0042363 A1 Feb. 15, 2018

(51) Int. Cl.
*A45D 40/26* (2006.01)
*A45D 34/04* (2006.01)

(52) U.S. Cl.
CPC ..... *A45D 40/265* (2013.01); *A45D 34/045* (2013.01)

(58) Field of Classification Search
CPC .. A45D 40/265; A45D 40/267; A45D 40/262; A45D 34/00; A45D 34/04; A45D 34/042; A45D 34/045; A45D 34/046; B65D 47/44; B65D 47/42; B05C 17/005; B05C 17/00503; B05C 17/00516
See application file for complete search history.

(56) References Cited

U.S. PATENT DOCUMENTS

| | | | | |
|---|---|---|---|---|
| 4,929,108 | A * | 5/1990 | Gueret | A45D 33/00 401/122 |
| 6,238,120 | B1 * | 5/2001 | Mark | A45D 19/02 401/134 |
| 9,427,064 | B2 * | 8/2016 | Kim | A45D 34/04 |
| 2004/0037613 | A1 * | 2/2004 | King | A45D 34/045 401/290 |
| 2008/0118298 | A1 * | 5/2008 | Marzuoli | A45D 34/045 401/185 |

* cited by examiner

*Primary Examiner* — David Walczak
(74) *Attorney, Agent, or Firm* — Heedong Chae; Lucem, PC

(57) ABSTRACT

A spuit-type container including a flocking tip having a temporary storage. A lid is coupled to an upper portion of a container body, a pressing button is mounted at an inner upper portion of the lid, a spuit bulb is formed under the pressing button to discharge and suck a cosmetic material, a spuit tube is coupled to a lower portion of the spuit bulb, a coupling part of the flocking tip is formed at a lower end portion of the spuit tube to be coupled to the flocking tip, a temporal storage is formed in the flocking tip to temporarily store the cosmetic material, and the temporal storage is formed therein with a distribution hole. The pressing and then releasing operation of the pressing button by a user operate the spuit bulb so that the spuit tube sucks the cosmetic material stored in the container body.

7 Claims, 9 Drawing Sheets

-- Prior Art --

-- Prior Art --

SPUIT-TYPE CONTAINER INCLUDING FLOCKING TIP HAVING TEMPORARY STORAGE

BACKGROUND OF THE INVENTION

1. Field of the Invention

The present invention relates to a spuit-type container including a flocking tip having a temporary storage, and more particularly to a spuit-type container including a flocking tip having a temporary storage, in which a lid is coupled to an upper portion of a container body, a pressing button is mounted at an upper portion of an inner part of the lid, a spuit bulb is formed under the pressing button to discharge and suck a cosmetic material, a spuit tube is coupled to a lower portion of the spuit bulb, a coupling part of the flocking tip is formed at a lower end portion of the spuit tube to be coupled to the flocking tip, a temporal storage is formed in the flocking tip to temporarily store the cosmetic material, and the temporal storage is formed therein with a distribution hole. Accordingly, if a user presses and then releases the pressing button of the lid, the spuit bulb is operated so that the cosmetic material stored in the container body can be sucked into the spuit tube. If the user separates the lid from the container body to allow the flocking tip of the lower end portion of the spuit tube to be close contact with a skin, the cosmetic material stored in the temporal storage of the flocking tip is discharged through the distribution hole of the flocking tip and the skin of the user can be massaged using the flocking tip.

2. Description of the Related Art

Cosmetics refer to compositions which are used for a human body in order to add charming of the human body by making the human body clean and beautiful, to change the appearance of the human body into being brighter, to maintain skin or hair in a healthy state, or to enhance the skin or the hair, and to exert slight influence on the human body.

The cosmetics may be mainly classified into basic, color, and functional cosmetics.

The functional cosmetics are referred to as cosmetics to help with skin whitening skin wrinkle repair, or skin protection from ultraviolet ray.

The contents of such functional cosmetics are high priced, and packaged in small amount. Accordingly, a container to receive the contents mainly has a compact size. Accordingly, in the case of a cosmetic product simply includes a lid and a container, a user may put on cosmetics with a hand, so that the cosmetics may be contaminated.

In order to solve the problem, as shown in FIG. 1, a spuit-type cosmetic container is disclosed in Korean Utility Model Registration No. 20-0463638, in which a lid is coupled to an upper body of a container body, a pressing button is mounted at an upper portion of an inner part of the lid, and a spuit tube 1 is formed at a lower portion of the pressing button. Accordingly, if the pressing button is pressed, a cosmetic material stored in the container body is sucked into the spuit-type tube 1. If a user opens the lid and places the spuit-type tube 1 on a skin and presses the pressing button to discharge the cosmetic material, thereby preventing the cosmetic materials from being contaminated or wasted by the hand.

However, the spuit tube 1 according to the present invention only discharges the sucked cosmetic material and has no function of massaging a skin. Accordingly, a user must separately prepare a massage appliance.

In order to solve the problem, as shown in FIG. 2, a spuit-type cosmetic container having a massage pendulum is disclosed in Korean Utility Model Registration No. 20-0474535, in which a lid is coupled to an upper body of a container body, a pressing button is mounted at an upper portion of an inner part of the lid, and a spuit tube 2 is formed at a lower portion of the pressing button, and a massage pendulum 3 is pivotally coupled to a lower end portion of the spuit tube 2. Accordingly, if the pressing button is pressed, a cosmetic material stored in the container body is sucked into the spuit-type tube 2. If a user opens the lid, places the massage pendulum 3 on a skin and presses the pressing button to discharge the cosmetic material. Thereafter, the user may use the cosmetic material while massaging the skin using the massage pendulum 3 coupled to the spuit tube 2.

However, according to the related art, when the cosmetic material sucked into the spuit tube 2 is discharged from the spuit tube 2 to the skin by pressing the pressing button, the discharge amount of the cosmetic materials is varied with force of pressing the pressing button, so that the cosmetic material may be wasted.

SUMMARY OF THE INVENTION

The present invention is made to solve the problems occurring in the related arts, and an object of the present invention is to a spuit-type container including a flocking tip having a temporary storage in which a lid is coupled to an upper portion of a container body, a pressing button is mounted at an upper portion of an inner part of the lid, a spuit bulb is formed under the pressing button to discharge and suck a cosmetic material, a spuit tube is coupled to a lower portion of the spuit bulb, a coupling part of the flocking tip is formed at a lower end portion of the spuit tube to be coupled to the flocking tip, a temporal storage is formed in the flocking tip to temporarily store the cosmetic material, and the temporal storage is formed therein with a distribution hole. Accordingly, if a user presses and releases the pressing button of the lid, the spuit bulb is operated so that the cosmetic material stored in the container body can be sucked into the spuit tube. If the user separates the lid from the container body to allow the flocking tip of the lower end portion of the spuit tube to be close contact with a skin, the cosmetic material stored in the temporal storage of the flocking tip is discharged through the distribution hole of the flocking tip and the skin of the user can be massaged using the flocking tip.

Another object of the present invention is to provide a spuit-type container including a flacking tip having a temporary storage, enabling the flocking tip immersed with the cosmetic material to apply the cosmetic material to a skin of a user in contact to the skin of the user as the surface of the flocking tip is formed of a soft fiber material, so that the flocking tip is be immersed with the cosmetic material.

The present invention provides a spuit-type container including a flocking tip having a temporary storage. The spuit-type container includes a container body having an inner part to receive a cosmetic material and an upper portion formed therein with an opening, a lid coupled to the opening of the container body, a pressing button mounted in an upper portion of the lid movably up and down, a spuit bulb formed under the pressing button to suck or discharge a cosmetic material, a spuit tube coupled to a lower portion of the spuit bulb, and formed at a lower end portion thereof with a coupling part, and a flocking tip couple to the coupling part of the spuit tube. The flocking tip is formed therein with a temporal storage to temporarily store the cosmetic material and formed in an outer circumferential surface thereof with a distribution hole formed through the temporal storage.

In addition, the opening of the container body is additionally coupled to a wiper to wipe the cosmetic material off the spuit tube or the flocking tip.

In addition, preferably, the spuit bulb includes an elastic material having restoring force, and the elastic material includes at least one of natural rubber, elastomer, acrylonitrile-butadiene rubber (NBR), and silicon rubber.

Further, a surface of the flocking tip includes a soft fiber material to be immersed with the cosmetic material.

Further, distribution holes may be formed in both lateral sides of a lower portion of the flocking tip and have a circular shape.

In addition, distribution holes may be formed in both lateral sides of an upper portion of the flocking tip and have a semicircular shape.

In addition, one distribution hole may be formed in a flat shaped lower end of the flocking tip.

As described above, according to the spuit-type container including the tip having the temporary storage of the present invention, the lid is coupled to the upper portion of the container body, the pressing button is mounted at the upper portion of the inner part of the lid, the spuit bulb is formed under the pressing button to discharge and suck the cosmetic material, the spuit tube is coupled to the lower portion of the spuit bulb, the coupling part of the flocking tip is formed at the lower end portion of the spuit tube to be coupled to the flocking tip, the temporal storage is formed in the flocking tip to temporarily store the cosmetic material, and the temporal storage is formed therein with a distribution hole. Accordingly, if a user presses and releases the pressing button of the lid, the spuit bulb is operated so that the cosmetic material stored in the container body can be sucked into the spuit tube. If the user separates the lid from the container body to allow the flocking tip of the lower end portion of the spuit tube to be close contact with a skin, the cosmetic material stored in the temporal storage of the flocking tip is discharged through the distribution hole of the flocking tip and the skin of the user can be massaged using the flocking tip.

In addition, as the surface of the flocking tip is formed of a soft fiber material, so that the flocking tip is be immersed with the cosmetic material, the flocking tip can be immersed with the cosmetic material to apply the cosmetic material to a skin of a user in contact to the skin of the user.

DETAILED DESCRIPTION OF THE INVENTION

Hereinafter, one embodiment of the spuit-type container including flocking tip having temporary storage according to the present invention will be described with reference to accompanying drawings.

Figure 1:
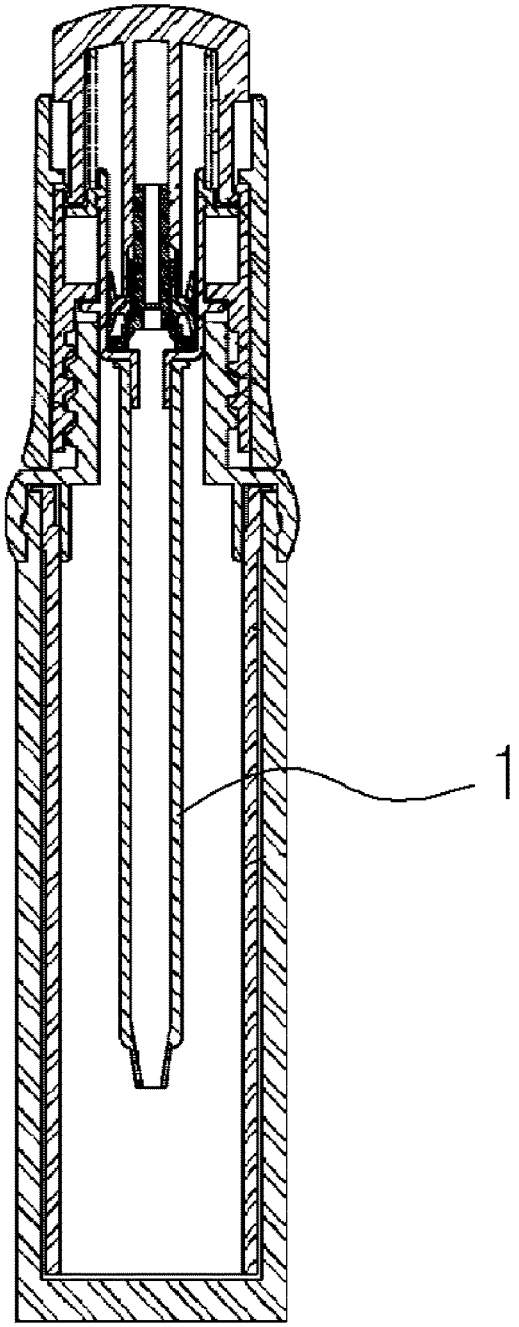
FIGS. 1 and 2 are sectional views showing spuit-type containers according to the related arts.
Figure 2:
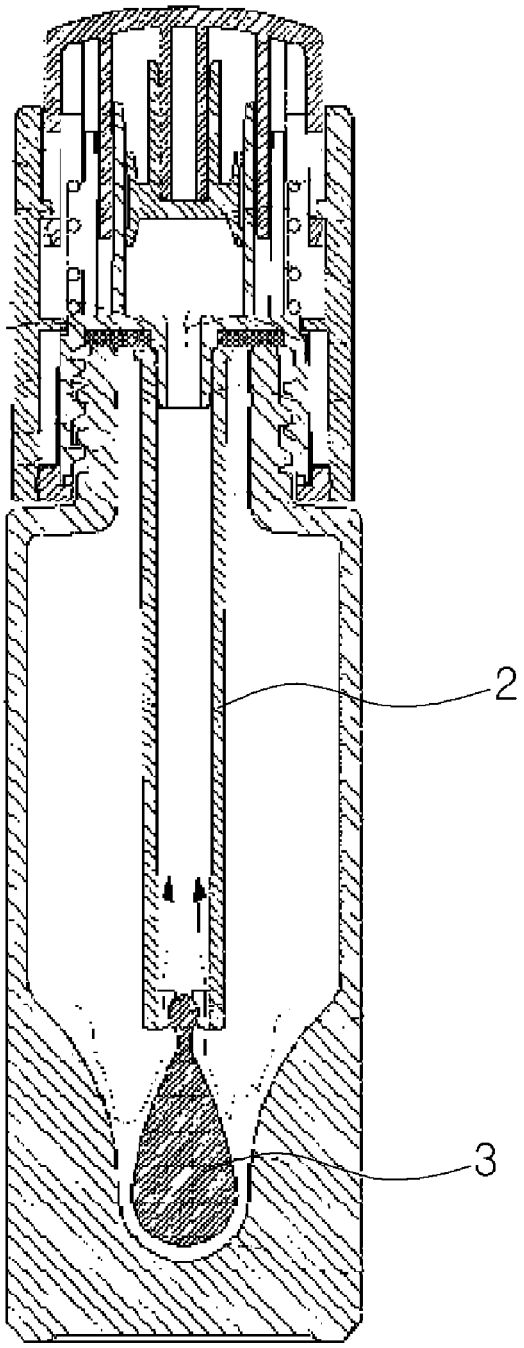
Figure 3:
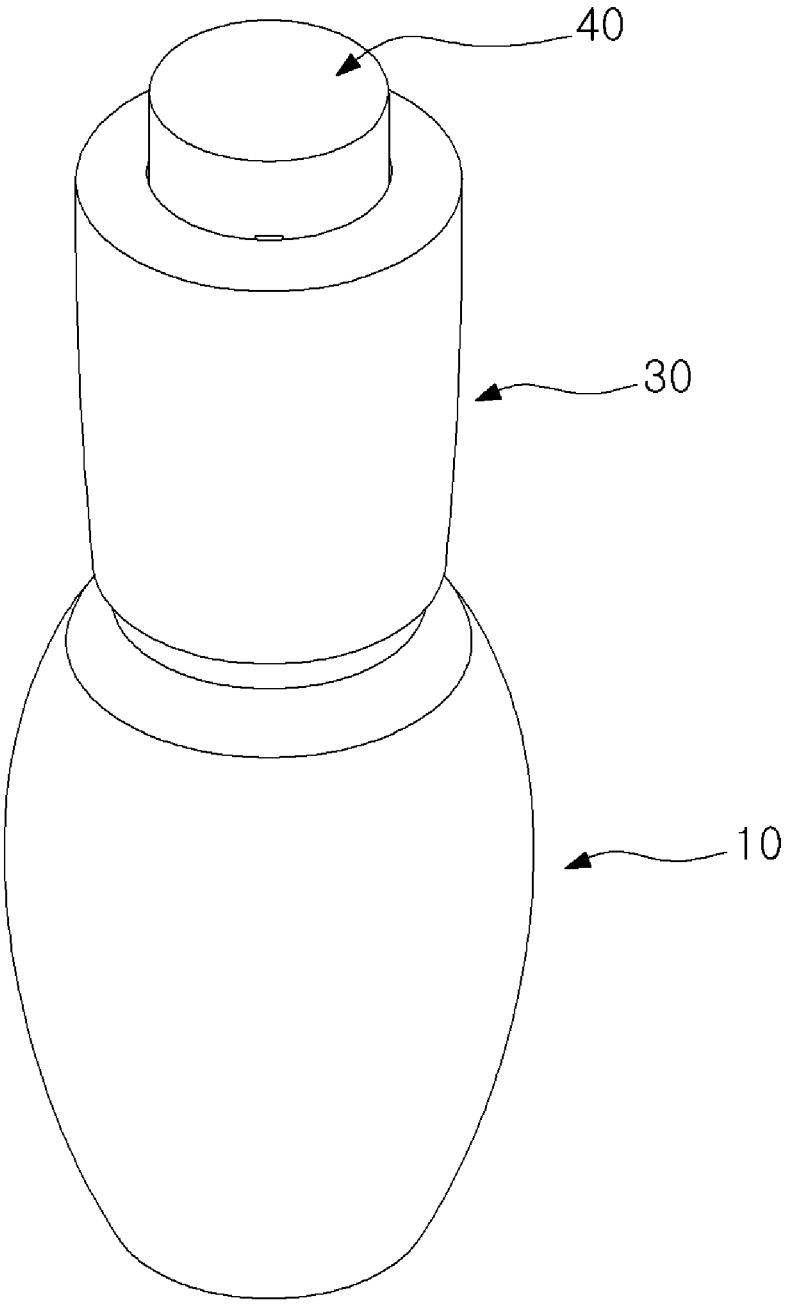
FIG. 3 is a perspective view showing a spuit-type container including a flocking tip having a temporary storage according to one embodiment of the present invention.
Figure 4:
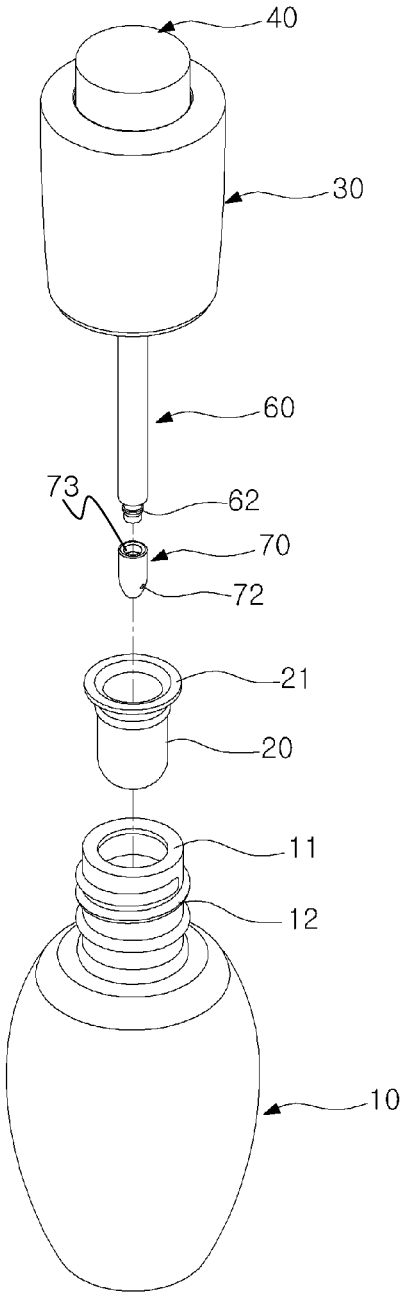
FIG. 4 is an exploded perspective view showing the spuit-type container including the flocking tip having the temporary storage according to one embodiment of the present invention.
Figure 5:
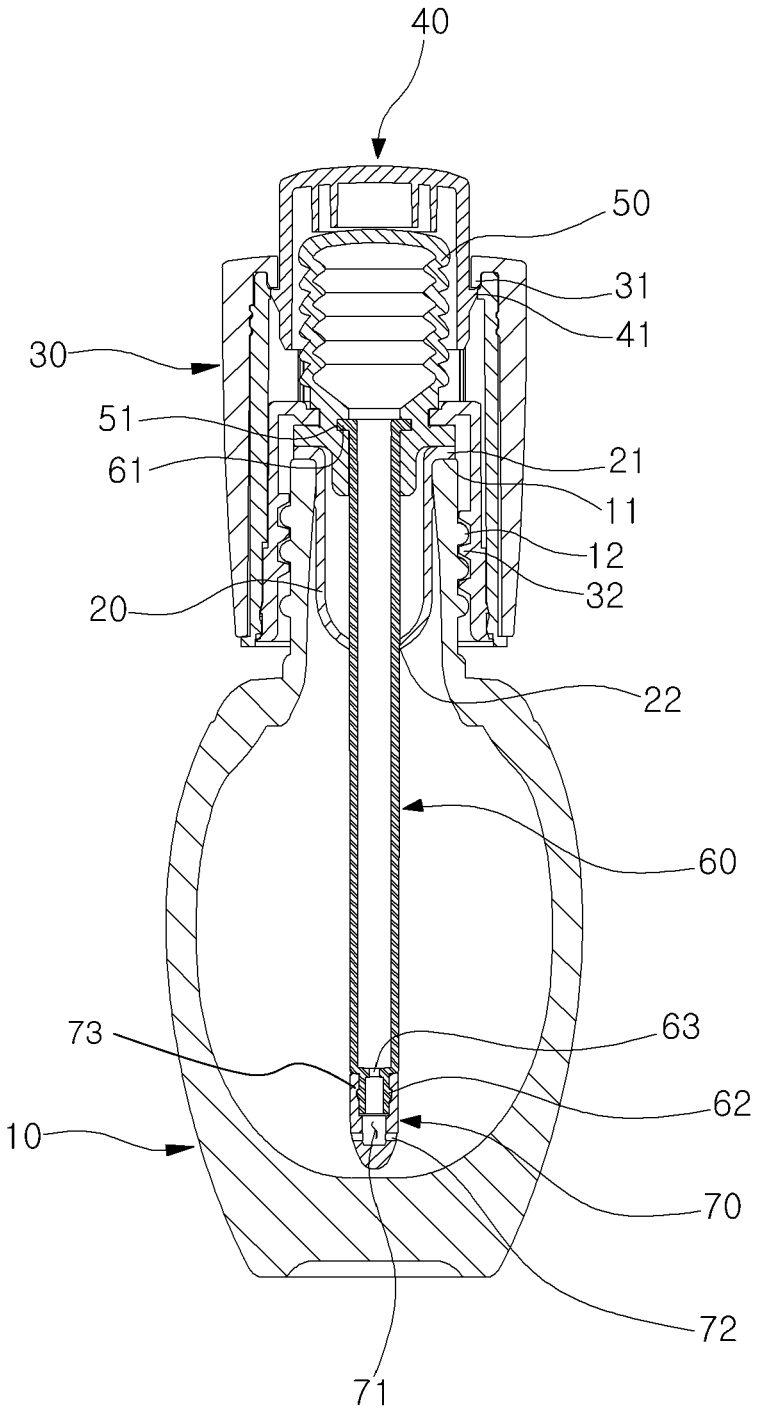
FIG. 5 is a sectional view showing the spuit-type container including the flocking tip having the temporary storage according to one embodiment of the present invention.
Figure 6:
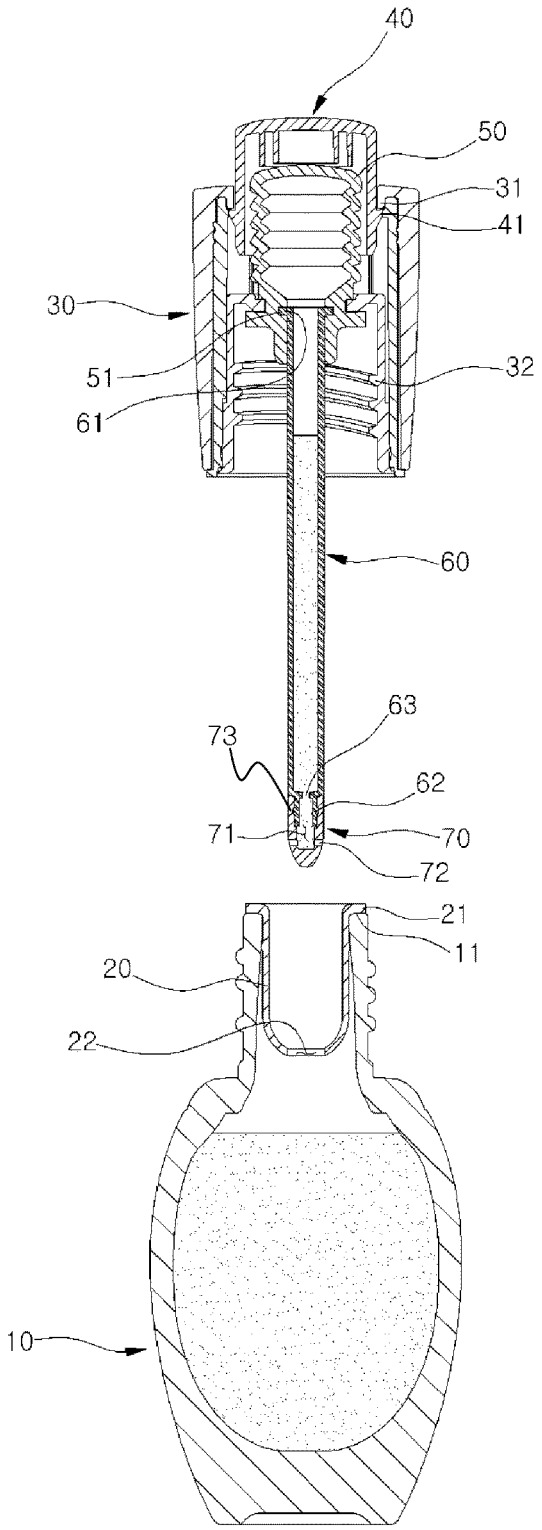
FIG. 6 is a sectional view showing a separation state of a spuit tube of the spuit-type container including the flocking tip having the temporary storage according to one embodiment of the present invention.
Figure 7:
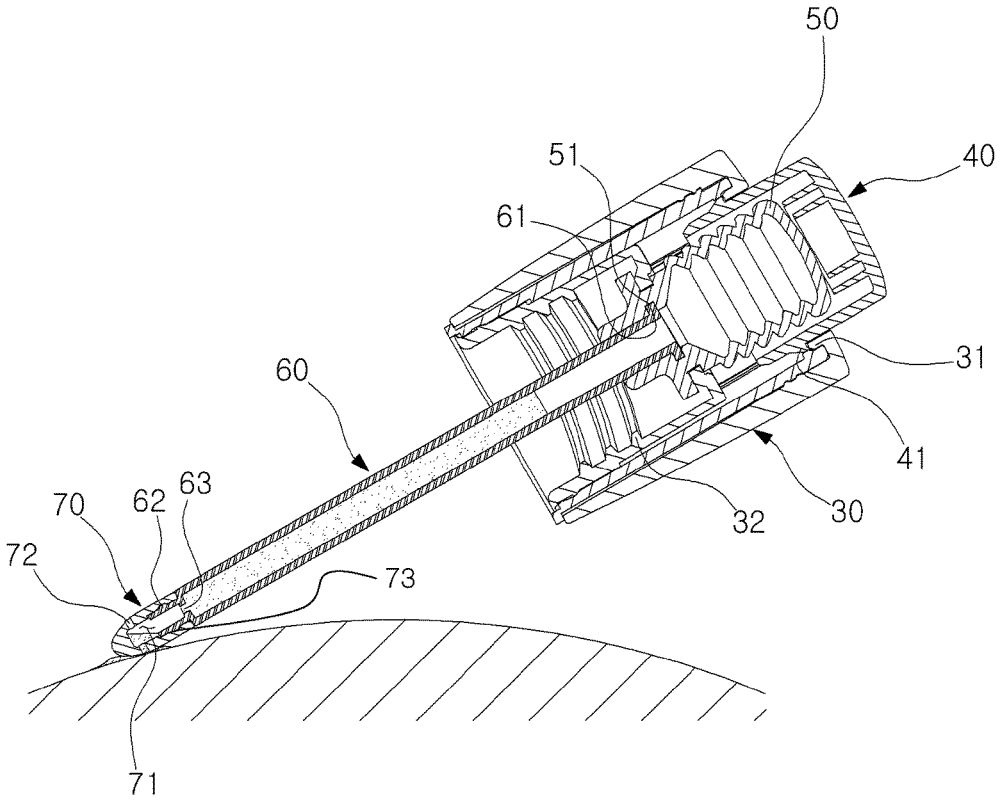
FIG. 7 is a sectional view showing the spuit-type container including the flocking tip having the temporary storage according to one embodiment of the present invention, which applies a cosmetic material to a skin.
Figure 8:
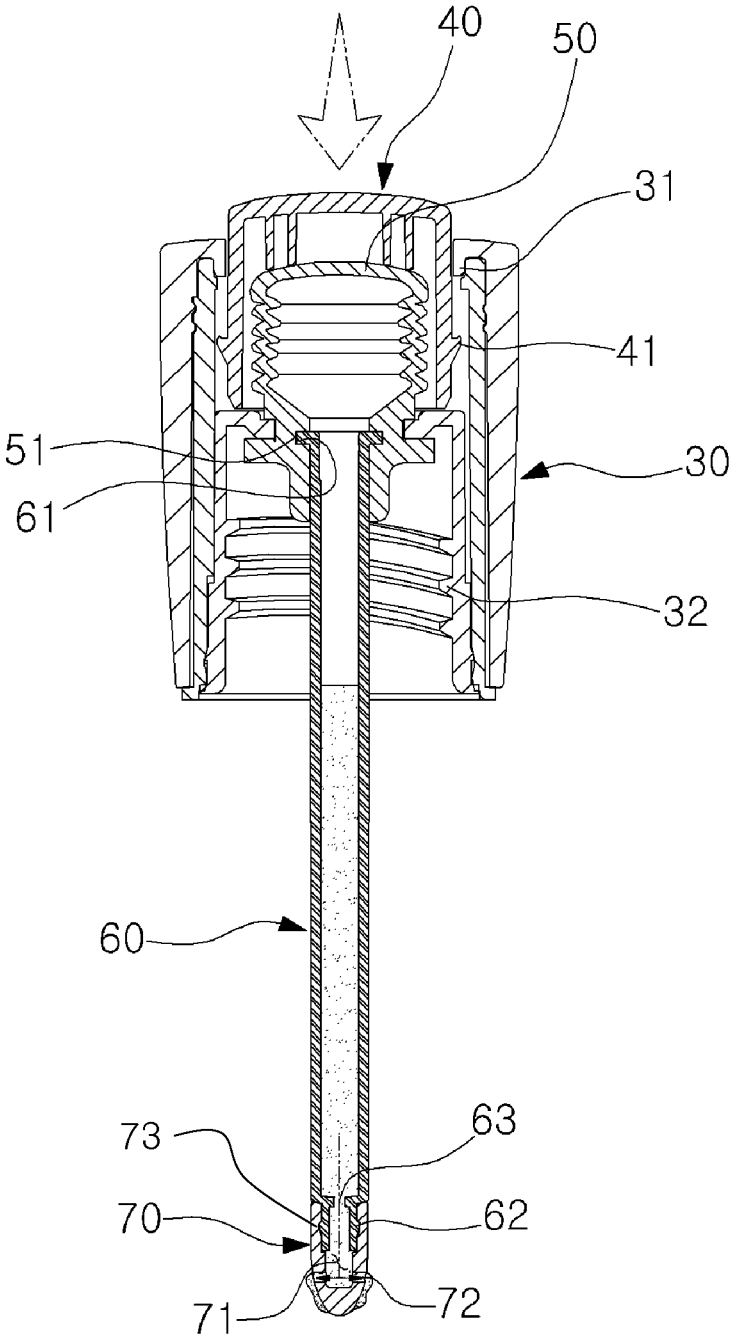
FIG. 8 is a sectional view showing a pressing state of a pressing button of the spuit-type container including the flocking tip having the temporary storage according to one embodiment of the present invention.
Figure 9:
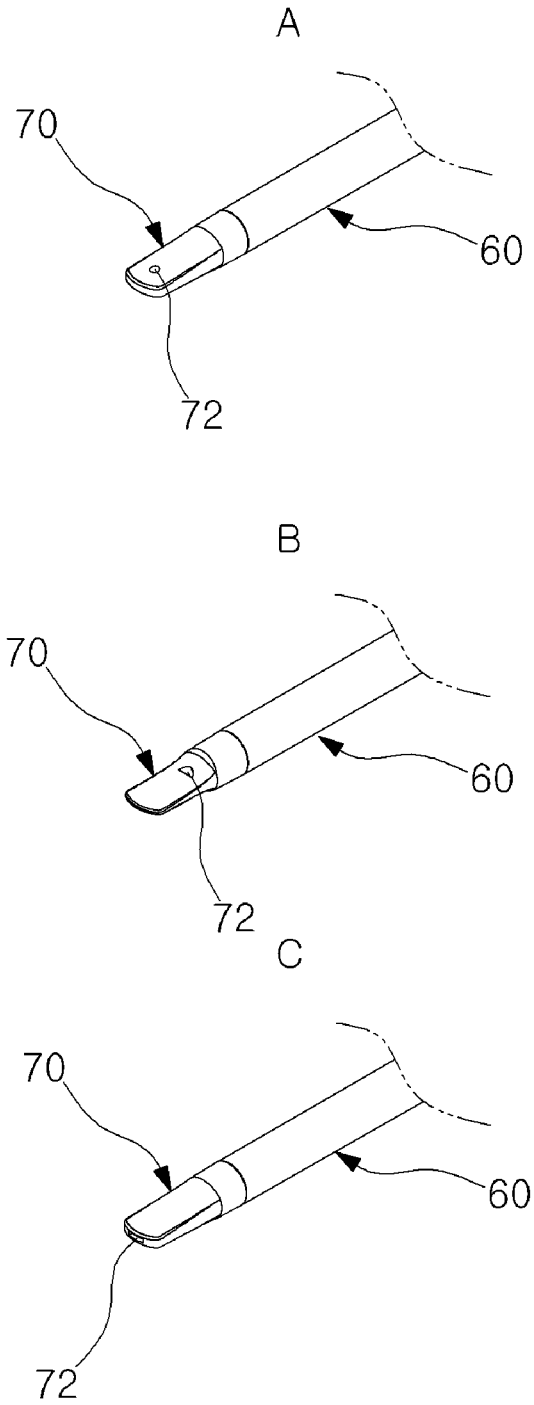
FIG. 9 is a view showing various shapes of the flocking tip in the spuit-type container including the flocking tip having the temporary storage according to one embodiment of the present invention.

FIG. 3 is a perspective view showing the spuit-type container including the flocking tip having the temporary storage according to one embodiment of the present invention. FIG. 4 is an exploded perspective view showing the spuit-type container including the flocking tip having the temporary storage according to one embodiment of the present invention. FIG. 5 is a sectional view showing the spuit-type container including the flocking tip having the temporary storage according to one embodiment of the present invention. FIG. 6 is a sectional view showing a separation state of a spuit tube of the spuit-type container including the flocking tip having the temporary storage according to one embodiment of the present invention. FIG. 7 is a sectional view showing the spuit-type container including the flocking tip having the temporary storage according to one embodiment of the present invention, which applies a cosmetic material to a skin. FIG. 8 is a sectional view showing a pressing state of a pressing button of the spuit-type container including the flocking tip having the temporary storage according to one embodiment of the present invention. FIG. 9 is a view showing various shapes of the flocking tip in the spuit-type container including the flocking tip having the temporary storage according to one embodiment of the present invention.

The spuit-type container including the flocking tip having the temporary storage according to the present invention includes a container body 10 having an inner part to receive the cosmetic material and an upper portion formed therein with an opening 11, a lid 30 coupled to the opening 11 of the container body 10, a pressing button 40 mounted in an upper portion of the lid 30 movably up and down, a spuit bulb 50 formed under the pressing button 40 to suck or discharge the cosmetic material, a spuit tube 60 coupled to a lower portion of the spuit bulb 50, and formed at a lower end portion thereof with a coupling part 62, and a flocking tip 70 coupled to the coupling part 62 of the spuit tube 60.

The container body 10 receives the cosmetic material therein, has the opening 11 formed at the upper end thereof, and has a body thread 12 formed on an outer circumferential surface thereof.

A wiper 20 is fitted into the opening 11.

The body thread 12 is screwed with the lid 30 to seal the container body 10.

The wiper 20 is formed at an upper end thereof with a locking step 21 and at a lower end thereof with a passage 22.

As shown in FIG. 5, when the wiper 20 is fitted into the opening 11 of the container body 10, the locking step 21 is hanged on an upper end of the opening 11 to prevent the wiper 20 from being fallen into the container body 10.

The passage 22 is formed at a lower end of the wiper 20 for the entrance of the spuit tube 60 to wipe the cosmetic material off the spuit tube 60 or the flocking tip 70.

The lid 30 has an open upper portion, a locking step 31 is formed at the upper portion of the lid 30, and a lid thread 32 is formed on an inner circumferential surface of the lid 30.

Regarding the locking step 31, when the pressing button 40 is coupled into the upper portion of the lid 30, the pressing button 40 is locked to the locking step 31 to be prevented from being separated from the lid 30.

The lid thread 32 is screwed with the body thread 12 of the container body 10 to open or close the container body 10.

The pressing button 40 is formed on an outer circumferential surface thereof with a locking protrusion 41, and the locking protrusion 41 is locked to the locking step 31 of the lid 30, so that the pressing button 40 is prevented from being separated from the lid 30.

The spuit bulb 50 is located inside the pressing button 40.

The spuit bulb 50 is formed in an inside thereof with a coupling groove 51, and the spuit tube 60 is fixedly coupled to the coupling groove 51.

The spuit bulb 50 is preferably formed of a material which may be deformed by a pressing operation of the pressing button 40 and recovered to an original state thereof, and particularly preferably formed of at least one of natural rubber, elastomer, acrylonitrile-butadiene rubber (NBR), and silicon rubber.

The spuit tube 60 is coupled to the lower portion of the spuit bulb 50.

The spuit tube 60 is formed at an upper end thereof with an annular locking protrusion 61, at a lower end thereof with a coupling part 62, and in a lower portion thereof with a spuit tube hole 63.

The annular locking protrusion 61 is fixedly coupled to the coupling groove 51 of the spuit bulb 50 to prevent the spuit tube 60 from being separated from the spuit bulb 50.

The flocking tip 70 is coupled to the coupling part 62.

The spuit tube hole 63 serves as a passage allowing the cosmetic material received in the container body 10 to be introduced into the spuit tube 60 or discharged out of the spuit tube 60.

The flocking tip 70 is coupled to the coupling part 62 of the spuit tube 60.

The surface of the flocking tip 70 is formed of a soft fiber material to be immersed with the cosmetic material differently from that of a spuit-type container according to the related art.

Since the surface of the flocking tip 70 is immersed with the cosmetic material, the cosmetic material received into the spuit tube 60 may not be frequently discharged.

The flocking tip 70 is formed therein with a temporal storage 71 and formed in an outer circumferential surface thereof with a distribution hole 72 formed through the temporal storage 71.

The temporal storage 71 temporarily stores the cosmetic material.

As shown in FIG. 6, even if the spuit tube 60 is separated from the container body 10 in the state that the cosmetic material is stored in the temporal storage 71, the cosmetic material stored in the temporal storage 71 is not discharged through the distribution hole 72 because the surface tension force of the distribution hole 72 is greater than the weight of the cosmetic material stored in the temporal storage 71 so that the cosmetic material does not flow down from the temporal storage 71 through the distribution hole 72.

In order to use the cosmetic material stored in the temporal storage 71 by discharging the cosmetic material from the temporal storage, the pressing button 40 is pressed or the distribution hole 72 of the flocking tip 70 makes contact with the skin so that the cosmetic materials in the spuit tube 60 and the temporal storage 71 may be discharged.

As shown in FIG. 9, distribution holes 72 may be formed in a circular shape in both lateral sides of the lower portion of the flocking tip 70 and may be formed in a semicircular shape through both lateral sides of the upper portion of the flocking tip 70.

In addition, one distribution hole 72 may be formed in the lower end of the flocking tip 70 having a flat shape.

Hereinafter, the assembling method and the use state of the spuit tube of the flocking tip having the temporal storage according to one embodiment of the present invention will be described.

In order to assemble the spuit-type container including the flocking tip having the temporary storage according to the present invention, the wiper 20 is coupled to the opening 11 of the container body 10 having the cosmetic material received therein.

Thereafter, the pressing button 40 having the locking protrusion 41 is locked into the upper portion of the lid 30 having the locking step 31 movably up and down, and the spuit bulb 50 is coupled to the inside of the pressing button 40.

Further, the spuit tube 60 is coupled to the lower portion of the spuit bulb 50. In this case, the coupling part 62 is formed at the lower end portion of the spuit tube 60, and coupled to the flocking tip 70 formed therein with the temporal storage 71 and in the outer circumferential surface thereof with the distribution hole 72 through the temporal storage 71

Thereafter, the lid 30 is coupled to the container body 10 to finish the assembling of the spuit-type container.

In order to use the cosmetic material of the spuit-type container including the flocking tip having the temporary storage, which is assembled through the above method, the lid 30 is separated from the container body 10 as shown in FIG. 6.

After the lid 30 has been separated, as shown in FIG. 7, when one distribution hole 72 in the flocking tip 70 makes contact with a skin, the cosmetic material is discharged from the temporal storage 71 due to the surface tension with the skin, so that air is introduced into the other distribution hole 72. Then, the cosmetic material is applied to the skin by the fiber material of the outer circumferential surface of the flocking tip 70.

Thereafter, in order to further discharge the cosmetic material, as shown in FIG. 8, the pressing button 40 is pressed so that the cosmetic material received in the spuit tube 60 is discharged out of the flocking tip 70 through the distribution hole 72.

In addition, since the surface of the flocking tip 70 may be immersed with the cosmetic material, the user may use the cosmetic material received in the spuit tube 60 without frequently discharging the cosmetic material Although the spuit-type container including the flocking tip having the temporary storage according to the present invention has been described for the illustrative purpose, the present invention is not limited thereto. Those skilled in the art will appreciate that various modifications, additions and substitutions are possible, without departing from the scope and spirit of the invention as disclosed in the accompanying claims.

LIST OF REFERENCE NUMERALS

10: container body
20: wiper
12: body thread
22: passage
30: lid
31: locking step
32: lid thread
40: pressing button
41: locking protrusion
50: spuit bulb
51: coupling groove
60: spuit tube
61: annular locking protrusion
62: coupling part
63: spuit tube hole
70: flocking tip
71: temporal storage
72: distribution hole

What is claimed is:

1. A spuit-type container including a flocking tip having a temporary storage, the spuit-type container comprising:

a container body (10) having an inner part to receive a cosmetic material and an upper portion formed therein with an opening (11);

a lid (30) coupled to the opening (11) of the container body (10);

a pressing button (40) mounted in an upper portion of the lid (30) movably up and down;

a spuit bulb (50) formed under the pressing button (40) to suck or discharge the cosmetic material;

a spuit tube (60) coupled to a lower portion of the spuit bulb (50), and formed at a lower end portion thereof with a spuit tube hole (63) and a coupling part (62); and a flocking tip (70) including an interior recess (73) coupled to the coupling part (62) of the spuit tube (60), wherein the flocking tip (70) is formed therein with a temporal storage (71) to temporarily store the cosmetic material and formed in an outer circumferential surface thereof with at least one distribution hole (72) formed through the temporal storage (71), wherein the coupling part (62) includes a protruding portion corresponding to the interior recess (73), wherein a diameter of the spuit-tube hole (63) is narrower than a diameter of an interior of the spuit tube (60), and wherein the spuit tube (60) is contiguous with the spuit tube hole (63) and the temporal storage (71).

2. The spuit-type container of claim 1, wherein the opening (11) of the container body (10) is additionally coupled to a wiper (20) to wipe the cosmetic material off the spuit tube (60) or the flocking tip (70).

3. The spuit-type container of claim 1, wherein the spuit bulb (50) includes an elastic material having restoring force, and the elastic material includes at least one of natural rubber, elastomer, acrylonitrile-butadiene rubber (NBR), and silicon rubber.

4. The spuit-type container of claim 1, wherein a surface of the flocking tip (70) includes a soft fiber material to be immersed with the cosmetic material.

5. The spuit-type container of claim 1, wherein said at least one distribution hole (72) includes two distribution holes (72) formed in both lateral sides of a lower portion of the flocking tip (70) and have a circular shape.

6. The spuit-type container of claim 1, wherein said at least one distribution hole (72) includes two distribution holes (72) formed in both lateral sides of an upper portion of the flocking tip (70) and have a semicircular shape.

7. The spuit-type container of claim 1, wherein said at least one distribution hole (72) formed in a flat shaped lower end of the flocking tip (70).

* * * * *